US007415986B2

(12) United States Patent
Wu

(10) Patent No.: US 7,415,986 B2
(45) Date of Patent: Aug. 26, 2008

(54) REINFORCED STRUCTURE FOR COLLAPSIBLE AND WIND RESISTIBLE UMBRELLA

(76) Inventor: Hsien-Sao Wu, 306 Fifth Ave., 5th Follor, New York, NY (US) 10001

( * ) Notice: Subject to any disclaimer, the term of this patent is extended or adjusted under 35 U.S.C. 154(b) by 803 days.

(21) Appl. No.: 10/820,866

(22) Filed: Apr. 9, 2004

(65) Prior Publication Data

US 2005/0236024 A1 Oct. 27, 2005

(51) Int. Cl.
*A45B 25/22* (2006.01)

(52) U.S. Cl. ..... 135/33.7; 135/31

(58) Field of Classification Search ..... 135/31, 135/25.1, 25.3, 25.31, 29, 33.2, 26–27, 33.4, 135/33.7
See application file for complete search history.

(56) References Cited

U.S. PATENT DOCUMENTS 6,186,157 B1 * 2/2001 Lin et al. ..... 135/27
6,336,464 B1 * 1/2002 Ko ..... 135/29
6,588,439 B2 * 7/2003 Wu ..... 135/27
2003/0005951 A1 * 1/2003 Wu ..... 135/27
2004/0211452 A1 * 10/2004 Wu ..... 135/33.7
2004/0238020 A1 * 12/2004 Lee ..... 135/31

* cited by examiner

*Primary Examiner*—David R Dunn
*Assistant Examiner*—Danielle N Jackson

(57) ABSTRACT

Disclosed herein is a reinforced structure for collapsible and wind resistible umbrella comprising a telescoping backbone, an upper and a lower nests, a plurality of multi-sectionalized main umbrella ribs and auxiliary ribs, a first and a second umbrella covers, and a plurality of resilient bands. An elaborately designed jointing technique is applied to joint these main and auxiliary ribs so as to substantially reinforce the mechanical strength of the umbrella to withstand the wind force. The last section of each main rib divided into parallelly laid, shorter first subsection and longer second subsection makes it possible to lay two umbrella covers in a manner leaving a fissure therebetween so as to release the wind flowing out. Furthermore a resilient band is provided between each first subsection of the main rib and the second umbrella cover that contributes to keeping a definite separation between the first and second subsections of the main rib so as to prevent the umbrella from overturning.

1 Claim, 4 Drawing Sheets

REINFORCED STRUCTURE FOR COLLAPSIBLE AND WIND RESISTIBLE UMBRELLA

BACKGROUND OF THE INVENTION

1. Field of the Invention

The present invention relates to a reinforced structure for collapsible and wind resistible umbrella, and more particularly, to a structure for a collapsible umbrella whose multi-sectionalized main rib has an auxiliary rib bridging between the front end of last section of the main rib and the second section of the main rib such that the umbrella is strongly structured wind resistible.

2. Description of the Prior Art

An umbrella is one of the important accoutrements. In a sunny day, it may be employed as a parasol to shade harmful ultra violet ray, while in a rainy day, it is used to keep away the rain drips from the user's body so as to protect the user clean and healthy. Either the umbrella or the parasol was prevalent in bygone time, it still prevails in the present day, and surely it will be necessary in the future.

There are many types of umbrellas selective in the market, such as a normal type, a two-fold type, a three-fold type etc., all serve the user with their portability. However, in the structure of a multi-collapsible umbrella, too many nodes for supporting umbrella ribs may results in weakening the mechanical strength to withstand the wind pressure such that the umbrella is often collapsed and ruined by a strong wind force and pouring rainfall notwithstanding the wind attacks the outer surface of the umbrella cover as a wind pressure, or attacks the inner surface thereof as an extract force.

It is what the reason the inventor of the present invention has endeavored for years by continuous research and experimentation attempting to find out the remedy to rectify the inherent shortcomings of the conventional umbrella described above, and at last has succeeded in realizing the present invention.

SUMMARY OF THE INVENTION

These features and advantages of the present invention will be fully understood and appreciated from the following detailed description of the accompanying Drawings.

Accordingly, it is an object of the present invention to provide a reinforced structure for collapsible and wind resistible umbrella whose multi-sectionalized main rib has an auxiliary rib bridging between its front end of the first section and the second section of the main rib such that the umbrella can be strongly structured wind resistible.

It is another object of the present invention that the last section of the main umbrella rib is divided into unequally lengthed first and second sub-sections almost parallelly laid such that two umbrella covers can be laid on it in a superposing configuration with a fissure formed therebetween so as to release the wind force thereby achieving the wind resistible structure.

It is one more object of the present invention that in the above mentioned structure a resilient band is provided with one end fastened to the tailend of the first sub-section of the main rib and the other end sewn to the second sub-section of the main rib such that the first and the second subsection of the main rib can be kept apart with an appropriate distance by the elastic force of a resilient band thereby protecting the first section of the main rib from being overturned by the strong wind force.

To achieve these and other objects mentioned above, the reinforced structure for collapsible and wind resistible umbrella is composed of a plurality of multi-sectionalized main umbrella ribs and auxiliary ribs, a first and a second umbrella covers, and a plurality of resilient bands. Wherein the last section of the main umbrella rib is divided into unequally lengthed, almost parallelly laid first and second subsections. The former is shorter in length and is laid above the latter. The auxiliary rib is bridging between the front end of the first subsection and the second subsection. The first umbrella cover fixes its one end to an upper nest, while its other end is sewn onto the tailend of the first subsection of the main umbrella rib. The second umbrella cover fixes its one end to the head terminal of the second subsection of the main umbrella rib, while its other end is fixed to the tailend of the second subsection of the main umbrella rib. In this manner the rear portion of the first umbrella cover is superposed over the front portion of the second umbrella cover leaving a fissure therebetween so as to release the wind flow out therefrom.

The resilient band which fixes its one end to the tailend of the first subsection of the main umbrella rib and sewes its other end onto the second umbrella cover can limit the separation between the two sub-sections of the main rib by its resiliency so as to prevent overturning of the first subsection of the main rib. The auxiliary rib bridging between the front end of the first section of the main rib and the second section of main rib can strongly enhance the umbrella structure to resist a violent wind attack.

DETAILED DESCRIPTION OF THE PREFERRED EMBODIMENT

Figures 1A, 1B:
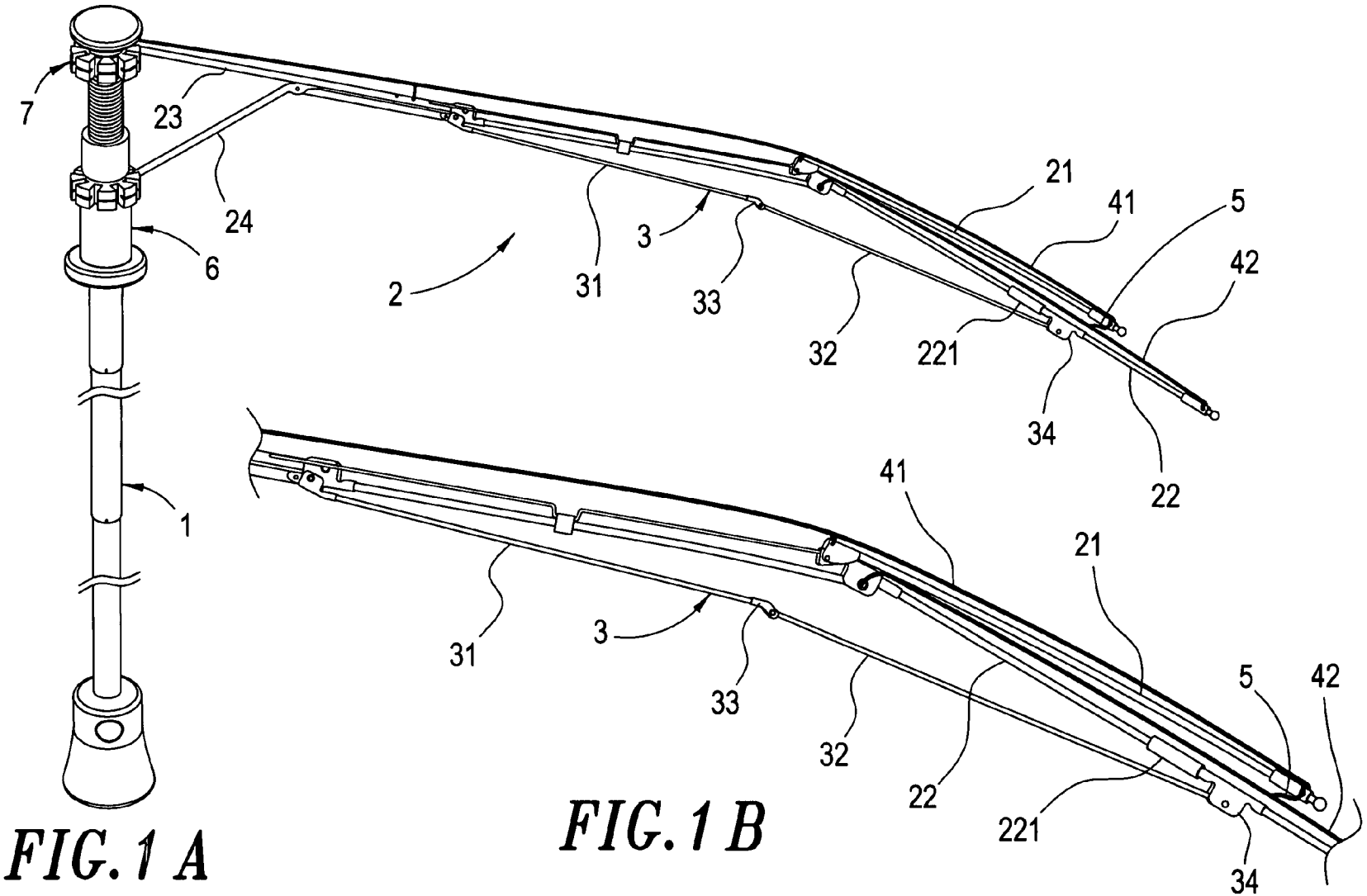
FIGS. 1A and 1B are partial schematic views of the reinforced structure for collapsible and wind resistible umbrella according to the present invention.

Referring to FIGS. 1A and 1B, the wind resistible umbrella of the present invention comprises a telescoping backbone 1, an upper nest 7, a lower nest 6, a plurality of multi-sectionalized main ribs 2, a plurality of auxiliary ribs 3, a first umbrella cover 41, a second umbrella cover 42, and a plurality of resilient bands.

The telescoping backbone 1 which being used to sustain the whole weight of the umbrella is formed of a plurality of telescoping tube sections.

The upper nest 7 is fixed to the cap of the umbrella on the top of the backbone 1.

The lower nest 6 is loosely sleeved over the backbone 1 to be slidably movable up and down along it.

Each of the multi-sectionalized main umbrella ribs 2 is formed of several rib sections hinged together, wherein the last section is divided into unequally lengthed, almost parallelly laid first subsection 21 and second subsection 22. The former is shorter in length than the latter and is laid above the latter. A stopper 221 is provided at a proper position on the second subsection 22. The uppermost sub-section 23 of the main umbrella rib 2 is tightened to the upper nest 7 with its head end and is supported by a brace 24 on the lower nest 6.

By so the multi-sectionalized main umbrella rib 2 is able to stretch when the lower nest 6 moves up along the telescoping back bone 1.

The auxiliary rib 3 is composed a first portion 31 and a second portion 32. The first portion 31 is jointed to the front end of the last section of the main umbrella rib 2 with its one end, while its other end is formed into a hinge joint 33 and is hinged with one end of the second auxiliary rib portion 32, and the other end of the second auxiliary rib portion 32 is terminated at a sleeve 34 which being sleeved over the second subsection 22 of the main umbrella rib 2 such that the sleeve 34 is slidable to and fro on the latter, with the stroke thereof controlled and limited by the stopper 221.

The first umbrella cover 41 is sewn to the upper nest 7 with its one end, and is sewn to the tailend of the first subsection 21 of the main umbrella rib 2 with its other end.

The second umbrella cover 42 is sewn to the head terminal of the second subsection 22 of the main umbrella rib 2 with its one end, and is sewn to the tailend of the second subsection 22 of the main umbrella rib 2. In this manner the front portion of the first umbrella cover 41 is superposed over the rear portion of the second umbrella cover 42 leaving a fissure therebetween so as to release the wind flowing out therefrom.

Figure 2:
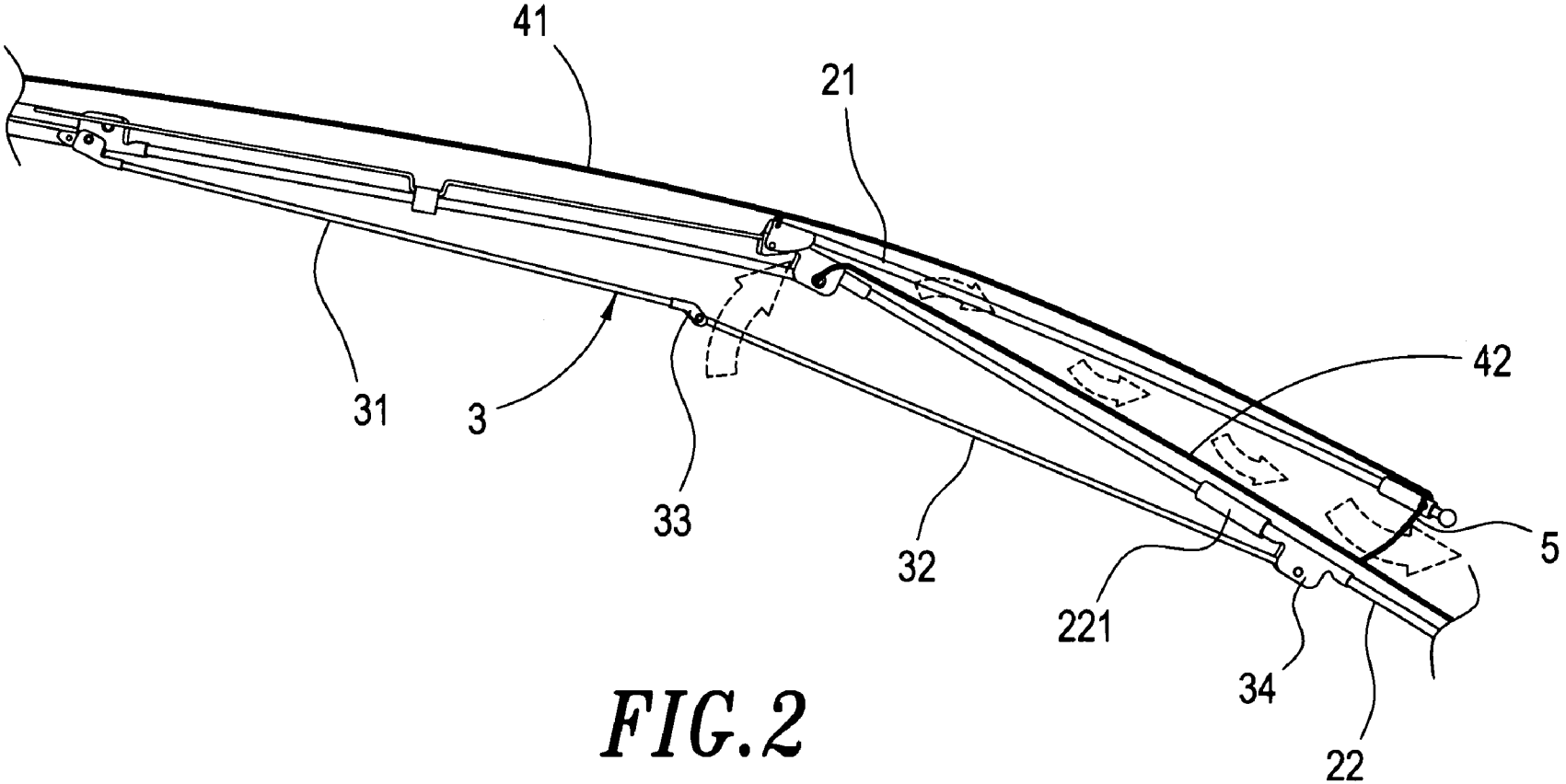
FIG. 2 is an illustrative view showing how the umbrella of the present invention releases the wind force.

The resilient band 5 which fixes its one end to the tailend of the fist subsection 21 of the main umbrella rib 2 and sewes its other end onto the second umbrella cover 42 is elaborately intercalated and concealed in the fissure formed between the two covers 41, 42 so as to avoid spoiling the appearance of the umbrella. As shown in FIG. 2, when the umbrella is subjected to a strong wind attck, the resiliency of the resilient band 5 can check the separation between the two subsections 21, 22 of the main umbrella rib 2 so as to prevent overturning of the first subsection 21 and recover its initial state.

Figure 3A:
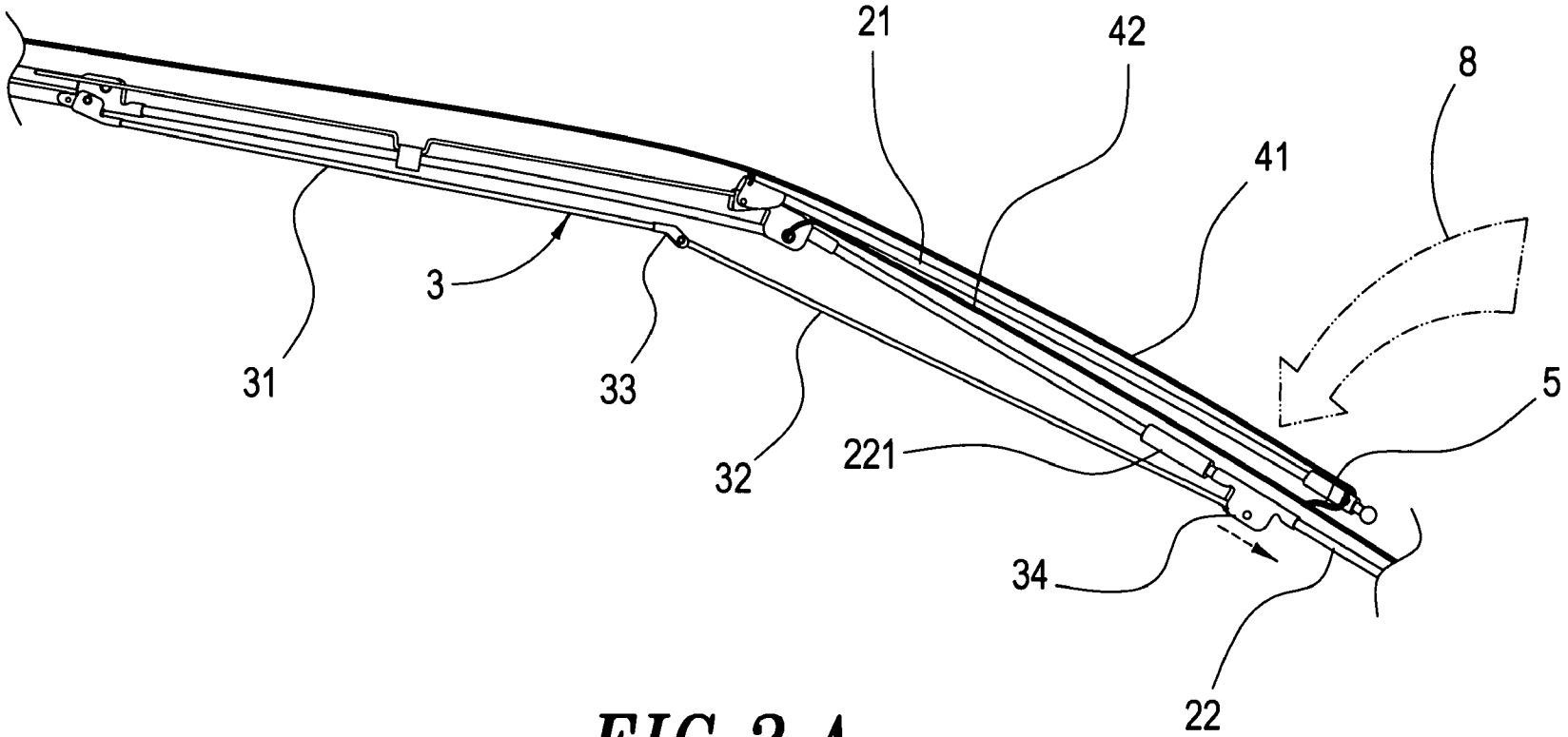
FIGS. 3A and 3B are the illustrative views demonstrating the operation of the umbrella structurally acting against the wind attack in an embodiment of the present invention.
Figure 3B:
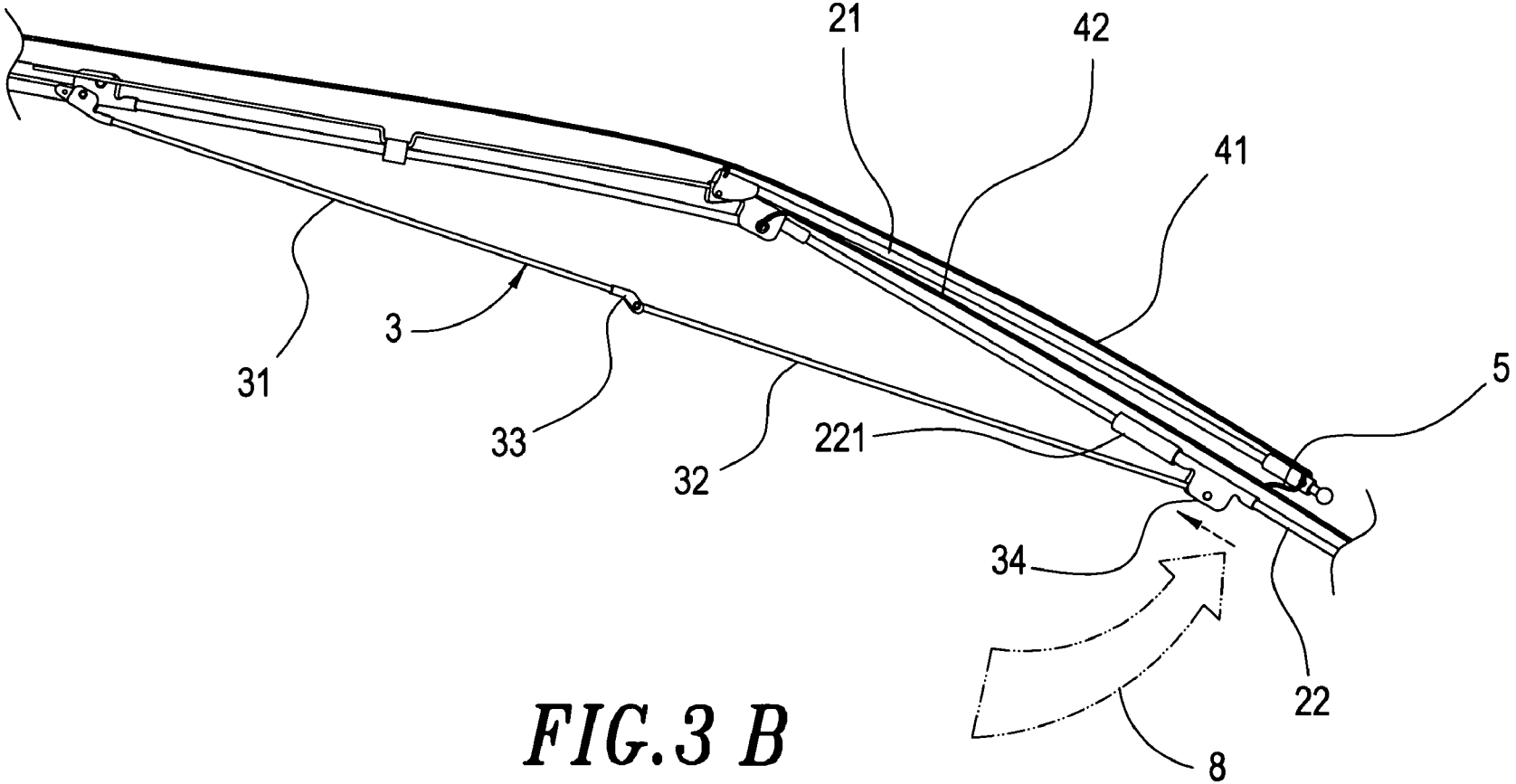

To understand how the umbrella structure of the present invention acts against the strong wind attack, reference can be made to FIGS. 3A, 3B which show an embodiment of the present invention. As a wind force 8 downwardly attack the umbrella to bend down the first subsection 21 of the main rib 2 the sleeve 34 to which the second portion 32 of the auxiliary rib 3 is terminated will receive a thrust force imparted from the first subsection 21, this thrust force is then successively imparted to the first portion 31 of the auxiliary rib 3 and is acting as a compressive force to the first portion 31 to sustain the umbrella to protect it from being crashed downwardly. After the wind calms down, the first and second sub sections 21, 22 of the main umbrella rib 2 together with the auxiliary rib 3 recover their initial state. On the other hand, in the case the wind force pulls up the umbrella, the second subsections 22 of the main rib 2 will be bent upwardly, this wind force imparted to the above mentioned sleeve 34, the second portion 32 (terminated to the sleeve 34), the first portion 31 of the auxiliary rib 3 will act as a tensile force to the above structural components. The upward overturning and collapsing of the umbrella is prevented by checking excessive backward displacement of the sleeve 34 by the stopper 221 provided to the second subsection 22 of the main rib 2. After the wind calms down, the first and second subsections 21, 22 of the main umbrella rib 2 together with the auxiliary rib 3 recover their initial state. In this manner the damage to the main umbrella ribs and auxiliary ribs by the strong wind attack can be avoided so as to prolong the umbrella's lifetime.

In all, the reinforced structure for collapsible and wind resistible umbrella disclosed herein has several noteworthy advantages compared to the conventional collapsible umbrella obtainable in the market, namely:

1. The elaborately designed jointing technique applied to joint umbrella main ribs and auxiliary ribs substantially enhances the mechanical strength of the umbrella structure to withstand the strong wind attack and avoid overturning of the whole umbrella due to bending stress even breaking the umbrella ribs.

2. The elaborate design idea that the last sections of the main umbrella ribs to be divided into the shorter first subsections and the longer second subsections makes it possible to lay two umbrella covers leaving a fissure therebetween so as to release the wind flowing out therefrom thereby avoiding the damage to the umbrella by wind force.

3. The resilient band provided between the first subsection of the main rib and the second umbrella cover contributes to keeping a definite separation between the first and second subsections of the main rib section so as to prevent the umbrella from overturning.

Many changes and modifications in the above described embodiment of the invention can, of course, be carried out without departing from the scope thereof. Accordingly, to promote the progress in science and the useful art, the invention is disclosed and intended to be limited only be the scope of the appended claims.

What is claimed is:

1. A reinforced structure for collapsible and wind resistible umbrella, comprising:

a telescoping backbone, including an upper nest fixed to top of the backbone and a lower nest loosely sleeved over the backbone to be slidably movable up and down;

a plurality of multi-sectionalized main umbrella ribs, each being formed of a plurality of rib sections including an uppermost subsection and a last section, the uppermost subsection being tightened to the upper nest with a head end and being supported by a brace connected on the lower nest, and a front portion of the last section being connected to the uppermost subsection and a rear portion of the last section being divided into almost parallelly laid shorter first subsection and longer second subsection, and the shorter first subsection being laid above the longer second subsection;

a plurality of auxiliary ribs, each including a first portion and a second portion, wherein the first portion has one end jointed to the front portion of the last section while the other end is formed into a hinge joint and hinged with one end of the second portion, and the other end of the second portion is terminated at a sleeve which is slidably sleeved over the second subsection, and wherein a stopper is provided on the second subsection to control and limit sliding stroke of the sleeve;

a first umbrella cover, covered over between said upper nest and said first subsection;

a second umbrella cover, covered over the second subsection such that a rear portion of the first umbrella cover is superposed over a front portion of the second umbrella cover, leaving a fissure between the first and the second umbrella covers; and a plurality of resilient bands, each fixing one end thereof to a tailend of the first subsection and sewing the other end thereof onto the second umbrella cover, being elaborately intercalated and concealed in the fissure so as to avoid spoiling an appearance of the umbrella, whereby when the umbrella is subjected to a strong wind attack, the resiliency of the resilient band checks separation between the first and the second subsections so as to prevent overturning of the first subsection, when an wind force downwardly attacks the umbrella to bend down the first subsection, the sleeve receives a thrust force imparted from the first subsection, the thrust force is then successively imparted to the first portion and is acting as a compressive force to the first portion to protect the umbrella from being crashed downwardly, and after the wind calms down, the first and the second subsections together with the auxiliary rib recover the umbrella to initial state, in the case the wind force pulls up the umbrella, the second subsections is bent upwardly, the wind force is then imparted to the sleeve, and the first portion acts as a tensile force and upward overturning and collapsing of the umbrella is prevented by checking excessive backward displacement of the sleeve by the stopper, after the wind calms down, the first and the second subsections together with the auxiliary rib recover the umbrella to the initial state, so that the damage to the main umbrella ribs and the auxiliary ribs by the strong wind attack are avoided.

* * * * *